United States Patent [19]

Roubo

[11] Patent Number: 4,880,019

[45] Date of Patent: Nov. 14, 1989

[54] HAIR COLORING IMPLEMENT

[76] Inventor: Valerie J. Roubo, 154 Whitehorse Ave., Trenton, N.J. 08610

[21] Appl. No.: 170,802

[22] Filed: Mar. 21, 1988

[51] Int. Cl.[4] ..... A45D 19/18

[52] U.S. Cl. ..... 132/270

[58] Field of Search ..... 132/207, 270, 319, 320, 132/208, 213, 216, 159, 333; 15/236.01, 236.02, 244.1, 244.4; 401/130, 139, 261, 5; D2B/7; D32/46

[56] References Cited

U.S. PATENT DOCUMENTS

| | | | |
|---|---|---|---|
| D. 167,663 | 9/1952 | Voss | D28/7 |
| 2,027,121 | 1/1936 | Ross | 132/159 |
| 3,103,933 | 9/1963 | Sanzo | 132/270 |
| 3,366,988 | 2/1968 | Menkin et al. | 15/244.1 |

*Primary Examiner*—Robert Peshock
*Assistant Examiner*—Cary E. Stone
*Attorney, Agent, or Firm*—William L. Muckelroy

[57] ABSTRACT

An implement to be used in the treatment of human, animal or artificial hair provides an impervious platform for the application of a treating composition, such as a dye or bleach, for example, to a selected portion of the hair while shielding the remainder from contact with the composition. The platform has a beveled edge so adapted to provide direct access to the roots of the selected hair portion.

6 Claims, 1 Drawing Sheet

HAIR COLORING IMPLEMENT

BACKGROUND OF THE INVENTION

1. Field of the Invention

The present invention is directed to a novel implement for use in the treatment of hair to facilitate segregating strands of hair being treated from neighboring strands and, at the same time, provide access and close proximity to the roots of the segregated portions of the hair for the application of compositions for tinting, bleaching, or stripping of hair color, for example.

2. Description of the Prior Art

Except for black or very dark brown shades or, at the other end of the spectrum of human hair colors, white hair of the aged, it has long been appreciated that adjacent hairs in the human scalp are seldom of precisely the same shade, even when the hair color, overall, is not noticeably streaked, as is frequently evident when naturally colored hair has commenced to gray. In fact, the absence of such variations in the shades of individual hairs or strands can be a contributing factor to the "artificial" appearance and lack of liveliness which characterizes many coiffures of bleached and/or dyed hair. Accordingly, either by techniques and/or by the "take" of the dyes or bleaches used, the more skilled hair colorings affect a variation in the shades of different strands in the coiffures; this is done in order to achieve a liveliness which simulates that of a natural hair color or frequently, a frankly obvious cosmetic coloring of the hair.

A hair treating appliance which is the subject of U.S. Pat. No. 3,599,647 issued to Fabbri on Aug. 17, 1971 addresses this problem in a substantially different way. Moreover, a device for use in bleaching or coloring hair in discreet portions for artistic affect by Stahl, U.S. Pat. No. 4,224,954 issued on Sept. 30, 1980 discloses another method for use in bleaching or coloring descreet portions of the hair. It utilizes a relatively thin planar base member with a top U-shaped member hinged thereto. Yet another appliance provided by Sestito in U.S. Pat. No. 3,552,403, issued on Jan. 5, 1971 also addresses the problem in a novel way.

Of particular similarity is the hair spray shield issued to Hasselbusch, U.S. Pat. No. 3,272,208 on Sept. 13, 1966. This platform is used to dress and set hair. Its purpose is for use in a spraying operation to shield hair setting spray from striking a patron's face and clothing. Hasselbusch does not address the problem of gaining greater access to roots of the hair strands.

Heretofore, the method of obtaining the above described variation in hair coloring, which has been most efficient, from the combined aspects of (a) time and labor involved, and (b) for closest access to the roots of the hair strands has been the cap technique. By this technique, a cap similar to a bathing cap is worn by the patron whose hair is to be treated. The film of the cap is preferably transparent and may be provided with preformed perforations through which the strands of hair to be bleached, dyed, or otherwise treated are pulled by means of a hook inserted and then withdrawn through the perforations. The cap is randomly perforated and if the operator wishes to treat a strand other than one drawn through a preformed perforation, the film of the cap is perforated by the hook and a strand of hair is withdrawn. In either case, the cap then serves to separate the hair so that only that which is outside the cap will be treated. However, this particular technique has one serious drawback in that it does not provide for access or close proximity to the roots of the hair strand because of the nature of the cap and head and the way that the cap fits over the head and hair. Accordingly, after a relatively short period of time, the hair coloring applied grows out leaving distasteful and unsightly roots showing the natural color of the hair with only the outer portion of the strands showing the hair coloring. This occurs in a relatively short period of time. To lengthen the life of a treatment, the hair coloring has to be applied to the roots of the hair starting at the surface of the scalp.

It is an object of this invention to improve access to the roots of hair strands segregated for treatment.

It is an advantage of this invention that the separated strands of hair may be treated to the roots of the hair. With the cap technique, for example, only end portions of the strands are certain to be withdrawn for treatment. Those hairs which are treated to the roots are in the minority.

The present invention, in contrast to the prior art, provides a relatively thin planar base member wherein a first edge is beveled and a second edge is slanted such that the intersection of the second edge with one side of the planar base member forms an obtuse angle and the inner section of the side with another side of the planar base member forms an acute angle. The acute corner of the planar base member facilitates handling with one hand and also provides an extended surface area for coloring extra long strands of hair. Opposite the slanted end of the planar base member is an edge which is beveled to provide a substantially sharper edge than the remaining edges of the base member to facilitate access and close proximity to the roots of each strand of laid across the base member for coloring.

It is an advantage of the novel planar base member that it eliminates the time and labor heretofore involved, both in the above described cap technique and in other referenced prior art requiring strand by strand separation of the strands of hair to be treated. It is another advantage of this novel invention that the separated strands of hair are easily treated substantially to the roots of the hair by means of a non-lacerating beveled edge. Whereas, by the cap technique, for example, only end portions of the strands are certain to be withdrawn for treatment and those hairs which are treated to the roots are a substantial minority.

The novel invention avoids and substantially minimizes the piebald effect frequently obtained by the prior art methods and thus a more natural and attractive coiffure may be obtained. By using the device invented for carrying out this objective, an operator can quickly segregate a plurality of strands which may be treated throughout their entire length from the root to the tip end by laying on the pallet without the risk of contaminating any other portion of the hair. Thus, the ultimate color of the hair which has been so treated at the scalp will extend outwardly from the base of the hair strand.

Other objects and advantages of this invention will be apparent from the following specification, claims and drawings, in which:

A need for this unique implement for providing a platform for working on segregated strands of hair and at the same time providing greater access to the roots of these strands which are adjacent the scalp has not been heretofore adequately addressed in the art. However, the need for such an implement has existed for a considerable time including one that can be easily washed and sterilized and reused and yet inexpensive, easy to manufacture, and disposable.

SUMMARY OF THE INVENTION

As claimed, the present invention is a thin planar platform having four rounded corners, two substantially parallel edges, a beveled edge, and a fourth edge slanted in relationship to the beveled edge, the beveled edge being an operative edge placed adjacent the scalp to provide greater access to the roots of a strand of hair spread along the platform, the slanted edge facilitating ease in handling the platform and determining relatively different lengths of various strands of hair.

DETAILED DESCRIPTION OF A PREFERRED EMBODIMENT OF THE INVENTION

Although as stated above, the implement of the invention is adapted with a specific shape for use in conjunction with the beveled edge thereof it is to be understood that the invention is not limited to the shape created by the two parallel edges and the slanted edge but that other shapes are anticipated for use in conjunction with the beveled operative edge of the implement.

Figure 1:
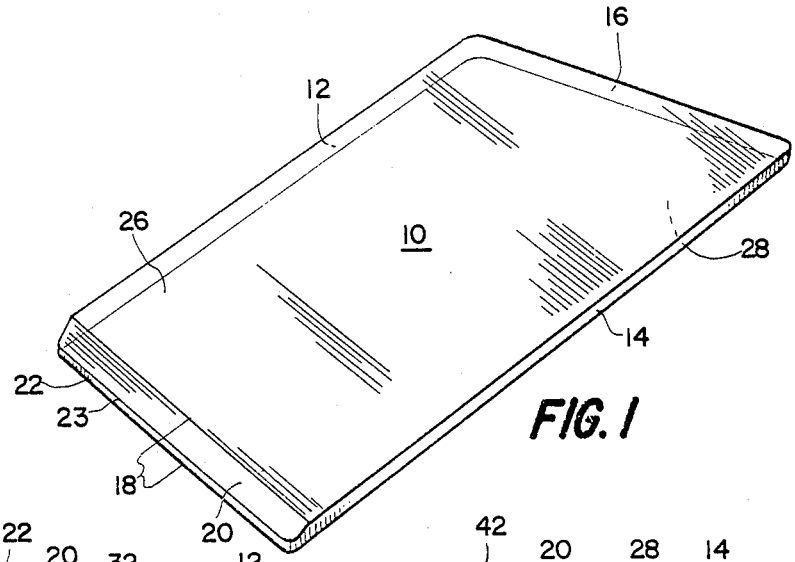
FIG. 1 shows a perspective view of a platform made according to this invention.

Referring in detail to the drawings, attention is directed to FIG. 1 wherein there is shown a preferred embodiment of the new and novel invention illustrating its essential features. Shown in FIG. 1 is an implement 10. The implement 10 has a first edge 12 which is parallel to a second edge 14. The implement 10 also has a third edge 16 which is slanted in relationship to a fourth edge 18.

The edge 18 of the implement 10 is a composite and made of a beveled edge 20 which is juxtaposed to a vertical sub-edge 22. An interface between the beveled edge 20 and the sub-edge 22 forms a juncture 23.

The implement 10 is planar and has a substantially flat top surface 26 and a substantially flat bottom surface 28.

Figure 2:
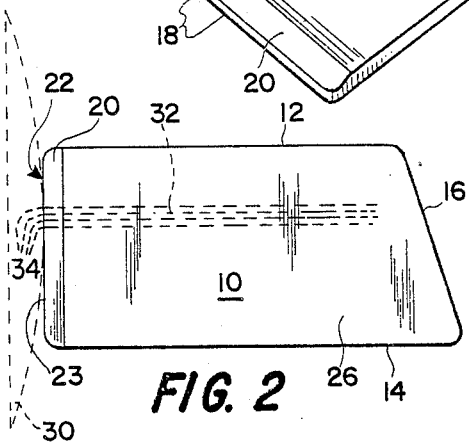
FIG. 2 is a top plan view of the platform of FIG. 1.

Referring to FIG. 2, the implement 10 is shown placed adjacent a person's scalp 30 with a strand of hair 32 extending along the length of the implement 10. In particular, the sub-edge 22 is placed adjacent the scalp 30 such that the roots 34 of the hair strand 32 are located substantially at the juncture 23 between the sub-edge 22 and the beveled edge 20. Thus, the beveled edge 20 in conjunction with the sub-edge 22 by creating the juncture 23 provides access and substantial proximity to the roots 34 of the hair strand 32.

Figure 3:
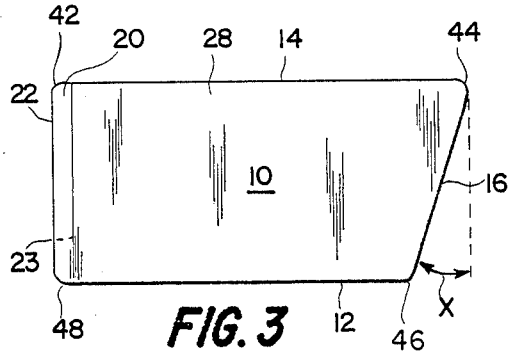
FIG. 3 is a bottom plan view of the platform shown in FIG. 1.

Referring to FIG. 3, there is shown the implement 10 with its slanted edge 16, beveled edge 20 and parallel edges 12 and 14. The slant of the edge 16 in relation to the beveled edge 20 and juncture 23 is designated as the angle X. In the preferred embodiment of the invention, the angle X is approximately 20 degrees, for example.

Figure 4:
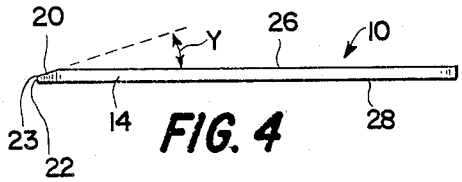
FIG. 4 is a view of the bottom end of the platform as shown in FIG. 2.
Figure 5:
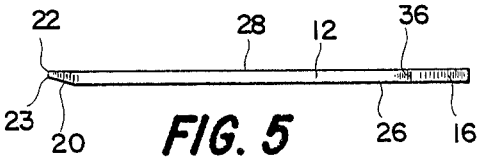
FIG. 5 is a view of the bottom edge of the platform as shown in FIG. 3.

FIG. 4 is a side view of the implement 10 looking on the edge 14. There, the beveled edge 20 is shown beveled at an angle Y. The angle Y is approximately 20 degrees, for example. Shown in FIG. 5 is a view of the edge 12 and its juncture 36 with the slanted edge 16.

Figure 6:
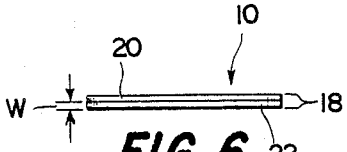
FIG. 6 is a view of the beveled edge of the platform shown in FIG. 2.

Shown in FIG. 6 is an end view of the implement 10 showing the edge 18 which is comprised of the slanted edge 20 and the sub-edge 22. There is shown a thickness W for the sub-edge 22. The thickness W is approximately 1/16 of an inch, for example, and is specifically selected to avoid lacerating the scalp 30.

Figure 7:
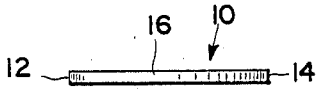
FIG. 7 is an end view showing the slanted ege of the platform shown in FIG. 3.

FIG. 7 is a view of the slanted edge 16 of the implement 10. The slanted edge 16 is shown inbetween two substantially parallel edges 12 and 14. The slanted edge 16 interconnects the edge 12 to the edge 14.

Referring again to FIG. 3, there is shown the implement 10 with rounded corners 42, 44, 46 and 48. These corners are rounded to a particular radius to eliminate the potential for a laceration of the scalp from a substantially pointed corner. The preferred radius for the corners has been determined as 3/16 of an inch.

Usage of the invention has resulted in a determination that the preferred length of the edge 14 is approximately 14 inches. The preferred and most easily operable width between edges 12 and 14 for the implement, namely the length of the beveled edge 22, is approximately 3 and $\frac{3}{4}$ inches. Experimentation and usage has also resulted in a determination that the preferred thickness of the implement, namely the separation of the bottom surface 26 from the top surface 28 is approximately = of an inch. The material of choice for manufacture of the implement 10 is polycarbonate or plexiglass.

What is claimed is:

1. A hair treating implement comprising a platform with a top and a bottom having a first edge comprising a first plane surface which is beveled in relation to said top surface wherein said platform further comprises a second edge comprising a second plane surface slanted in relation to said first edge wherein said first plane surface is beveled approximately 20 degrees.

2. The hair treating implement of claim 1 wherein said second plane surface is slanted approximately 20 degrees.

3. The hair treating implement of claim 2 wherein said platform has third and fourth edges.

4. The hair treating surface of claim 3 wherein said third and fourth edges are plane surfaces.

5. The hair treating implement of claim 4 further comprising first and second junctures where said first edge joins said third and fourth edges, respectively, and third and fourth junctures where said second edge joins said third and fourth edges, respectively, said junctures having means for preventing lacerations.

6. The hair treating implement of claim 4 further comprising a fifth plane surface adjacent said first plane surface and said bottom, said fifth plane surface interconnecting said third and fourth plane surfaces.

* * * * *